US005301511A

United States Patent [19]

Bartlett et al.

[11] Patent Number: 5,301,511

[45] Date of Patent: Apr. 12, 1994

[54] CRYOPUMP AND CRYOPANEL HAVING FROST CONCENTRATING DEVICE

[75] Inventors: Allen J. Bartlett, Milford, Mass.; Charles A. Stochl, Cumberland, R.I.; Anthony M. Guerra, Scituate, Mass.; Dale A. Dopson, Stoughton, Mass.; Paul Meroski, Melrose, Mass.; Thomas F. Stevens, Westborough, Mass.

[73] Assignee: Helix Technology Corporation, Mansfield, Mass.

[21] Appl. No.: 898,080

[22] Filed: Jun. 12, 1992

[51] Int. Cl.[5] ..... B01D 8/00

[52] U.S. Cl. ..... 62/55.5; 417/901

[58] Field of Search ..... 62/55.5; 417/901; 55/269

[56] References Cited

U.S. PATENT DOCUMENTS

| | | | |
|---|---|---|---|
| 4,198,829 | 4/1980 | Carle | 62/55.5 |
| 4,266,959 | 5/1981 | Welch | 62/55.5 |
| 4,530,213 | 7/1984 | Kadi | 62/55.5 |
| 4,718,241 | 1/1988 | Lessard et al. | 62/55.5 |
| 4,791,791 | 12/1988 | Flegal et al. | 62/55.5 |
| 4,815,303 | 3/1989 | Duza | 62/55.5 |
| 5,000,007 | 3/1991 | Haefner | 62/55.5 |

FOREIGN PATENT DOCUMENTS

| | | | |
|---|---|---|---|
| 0117523 | 9/1984 | European Pat. Off. . | |
| 0134942 | 3/1985 | European Pat. Off. . | |
| 0445503 | 9/1991 | European Pat. Off. . | |
| 2455712 | 8/1976 | Fed. Rep. of Germany . | |
| 222572 | 11/1985 | Japan | 62/55.5 |
| 113876 | 5/1987 | Japan | 62/55.5 |
| 106979 | 4/1989 | Japan | 62/55.5 |
| 4-47180 | 2/1992 | Japan | 62/55.5 |
| 92/14057 | 8/1992 | World Int. Prop. O. . | |

*Primary Examiner*—Ronald C. Capossela
*Attorney, Agent, or Firm*—Hamilton, Brook, Smith & Reynolds

[57] ABSTRACT

In a cryopump a frost concentrating device is affixed to a condensing cryopanel and provides surfaces for condensing gases which are cryopumped through an opening in the vacuum vessel. The surfaces of the frost concentrator extend towards the opening in the vacuum vessel and thus limit the amount of gases which condense on the surfaces of the condensing cryopanel facing the opening. The result is that the gap between the radiation shield and the condensing cryopanel does not become significantly narrowed by condensing gases, particularly in the area closest to the opening through which gases are cryopumped. This allows other gases to pass easily through the gap and condense on surfaces of the condensing cryopanel further away from the opening of the cryopump or to be adsorbed by an adsorbent material shielded by the condensing cryopanel.

40 Claims, 12 Drawing Sheets

CRYOPUMP AND CRYOPANEL HAVING FROST CONCENTRATING DEVICE

BACKGROUND OF THE INVENTION

Cryopumps currently available, whether cooled by open or closed cryogenic cycles, generally follow the same design concept. A low temperature second stage array, usually operating in the range of 4 to 25 K, is the primary pumping surface. This surface is surrounded by a high temperature cylinder, usually operated in the temperature range of 70 to 130 K, which provides radiation shielding to the lower temperature array. The radiation shield generally comprises a housing which is closed except at a frontal array positioned between the primary pumping surface and the chamber to be evacuated. This higher temperature, first stage, frontal array serves as a pumping site for higher boiling point gases such as water vapor.

In operation, high boiling point gases such as water vapor are condensed on the frontal array. Lower boiling point gases pass through that array and into the volume within the radiation shield and condense on the second stage array. A surface coated with an adsorbent such as charcoal or a molecular sieve operating at or below the temperature of the second stage array may also be provided in this volume to remove the very low boiling point gases. To prevent overloading of the adsorbent, the adsorbent is generally provided on surfaces which are protected by the second stage condensing array. With the gases thus condensed or adsorbed onto the pumping surfaces, only a vacuum remains in the work chamber.

SUMMARY OF THE INVENTION

In cryopumps where the radiation shield fits closely about the cryopanel array, there is limited space between the radiation shield and the cryopanel array. In cryopumps of this design, there is a tendency for lower boiling point gases to condense heavily on the surfaces of the cryopanel array closest to the opening through which gases are cryopumped. When this occurs, frost from these condensing gases significantly narrows the gap between the radiation shield and the cryopanel array, limiting the ability of other gases to reach either the condensing surfaces on the cryopanel array further away from the opening or the surfaces coated with adsorbent material. If the gap between the radiation shield and the cryopanel array is narrowed significantly, the pumping speed of the cryopump is greatly reduced.

The present invention prevents frost caused by condensing gases from significantly narrowing the gap between a close fitting radiation shield and cryopanel array, particularly in the area closest to the opening through which gases are cryopumped, thereby allowing the cryopump to continue to operate more efficiently and at higher speed.

The present invention provides a cryopump, and a cryopanel therein, which limits frost build up between a close fitting cryopanel array and radiation shield. Gases are cryopumped through an opening in a vacuum vessel. Within the vacuum vessel is a cryopanel which is cooled to cryogenic temperatures and supports adsorbent for adsorbing gases. A condensing cryopanel cooled to cryogenic temperatures faces the opening in the vacuum vessel and acts as a baffling device to shield the adsorbent cryopanel from condensing gases passing through the opening. Affixed to and extending from the condensing cryopanel and toward the opening in the vacuum vessel are surfaces of a frost concentrator for condensing gases. The frost concentrator is affixed to or formed from the outer surface of the condensing cryopanel which is in the closest proximity to the opening in the vacuum vessel.

A portion of the gases cryopumped through the opening in the vacuum vessel condenses on the extended surfaces, thus concentrating the frost in the region of the surfaces. The concentrator alters the normal distribution of frost on the surfaces reducing the amount of frost build-up in the gap between the radiation shield and the condensing cryopanel. In this manner the gap between the radiation shield and the condensing cryopanel is kept sufficiently open to allow other gases to pass through the gap and condense on surfaces of the condensing cryopanel further away from the opening of the vacuum vessel or be adsorbed by the adsorbent material. In addition, because the frost concentrator is a very efficient condenser of gases, the ability of the condensing cryopanel to shield the adsorbent may be relaxed.

The preferred frost concentrator of the present invention spans a substantial portion of the opening of the vacuum vessel and is made up of a number of fins crossing each other at their midpoints. The frost concentrator may be affixed to either the top or the side of the condensing cryopanel.

One form of condensing cryopanel of the present invention is a hollow cylinder having a number of openings with a corresponding number of louvres protruding from the outer walls. The condensing cryopanel is made from a sheet of metallic material and substantially encloses a cryopanel supporting an adsorbent material, preferably charcoal. The series of baffles and openings allow very low boiling point gases access to the interior of the condensing cryopanel while substantially shielding the adsorbent within the condensing cryopanel from higher boiling point gases. The cryopanel supporting adsorbent enclosed within the condensing cryopanel may be a hollow structure having a rectangular cross section where charcoal granules are adhered to outer surfaces of the structure.

Alternatively, the condensing cryopanel of the present invention can be a hollow structure made from a sheet of metallic material having radially staggered outer walls with a number of openings between the walls. The radially staggered walls allow very low boiling point gases access to the interior of the condensing cryopanel while substantially shielding the adsorbent within the condensing cryopanel from higher boiling point gases.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
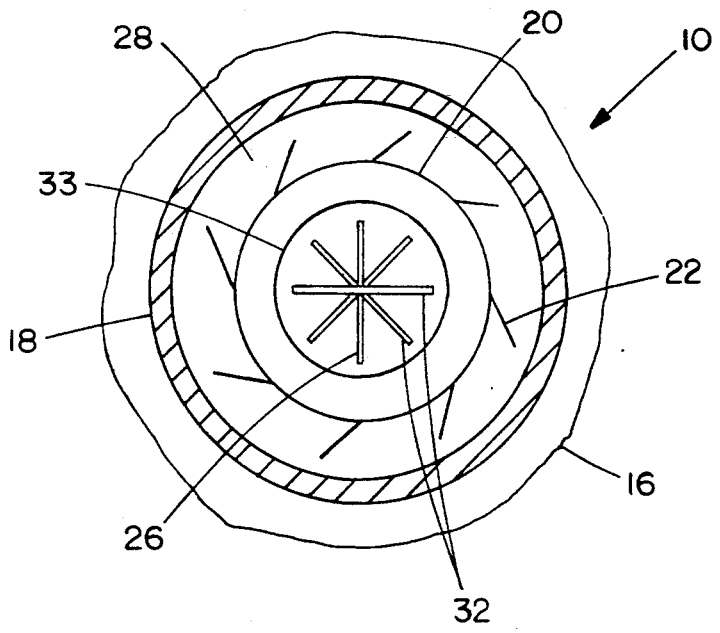
FIG. 1 is a sectional plan view of the preferred embodiment of the present invention for a cryopump having an opening on the top. The figure shows the frost concentrator affixed to the top of a cylindrical condensing cryopanel enclosed in the radiation shield.
Figure 2:
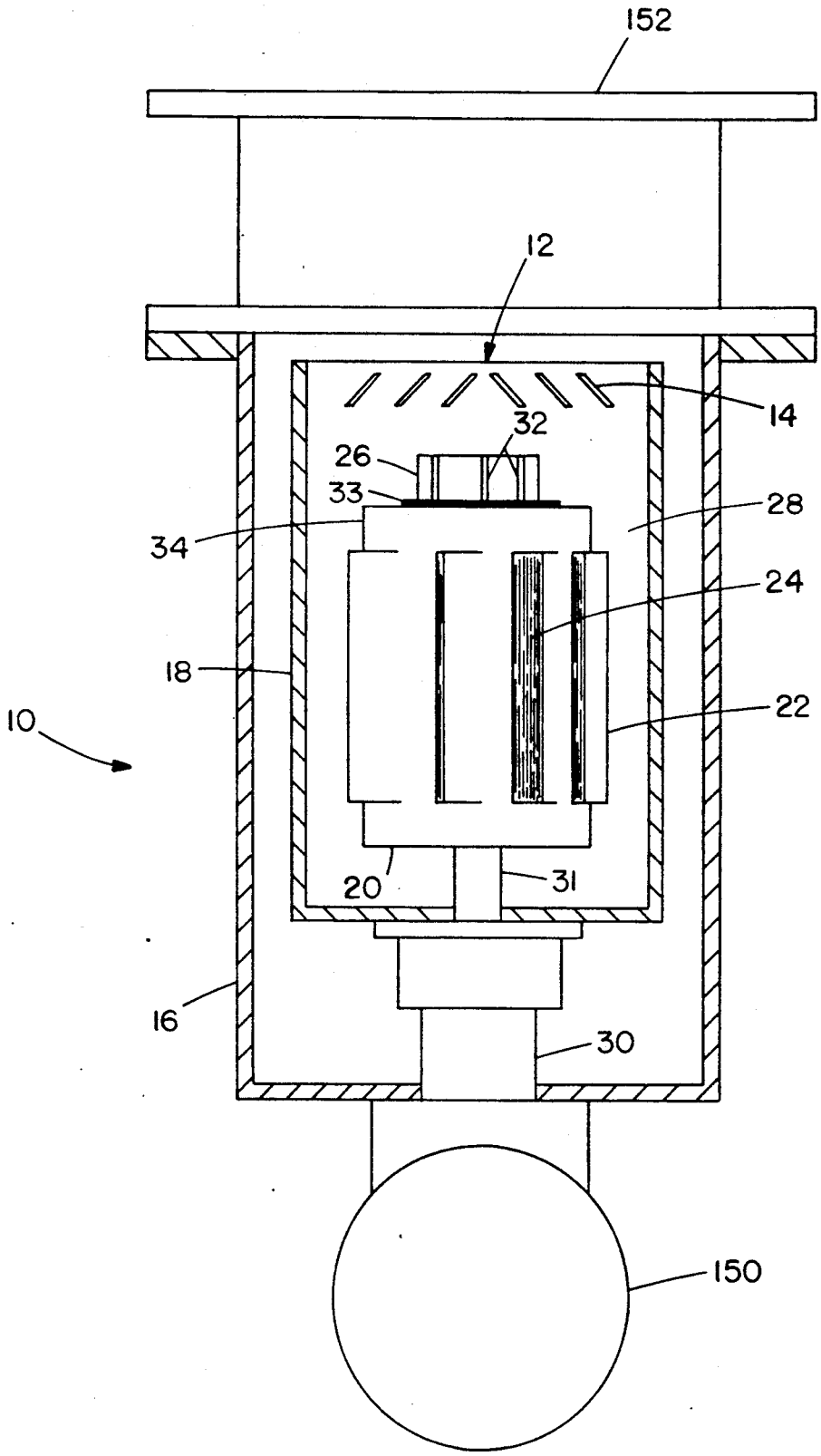
FIG. 2 is a sectional side view of the same embodiment of the present invention shown in FIG. 1.

FIGS. 1 and 2 depict the preferred embodiment of the present invention for a cryopump having an opening on the top for cryopumping gases into the cryopump. Gases enter cryopump 10 through opening 12 when gate valve 152 is opened and those gases pass over frontal array 14. Frontal array 14 is cooled to 70 to 130 K. and condenses higher boiling point gases such as water vapor. Lower boiling point gases such as hydrogen and argon pass through frontal array 14 and enter the interior of radiation shield 18. Radiation shield 18 is substantially enclosed by vacuum vessel walls 16 of cryopump 10. Radiation shield 18 is generally cooled to a temperature between 70 and 130 K. and provides radiation shielding for cylindrical cryopanel 20.

Figure 17:
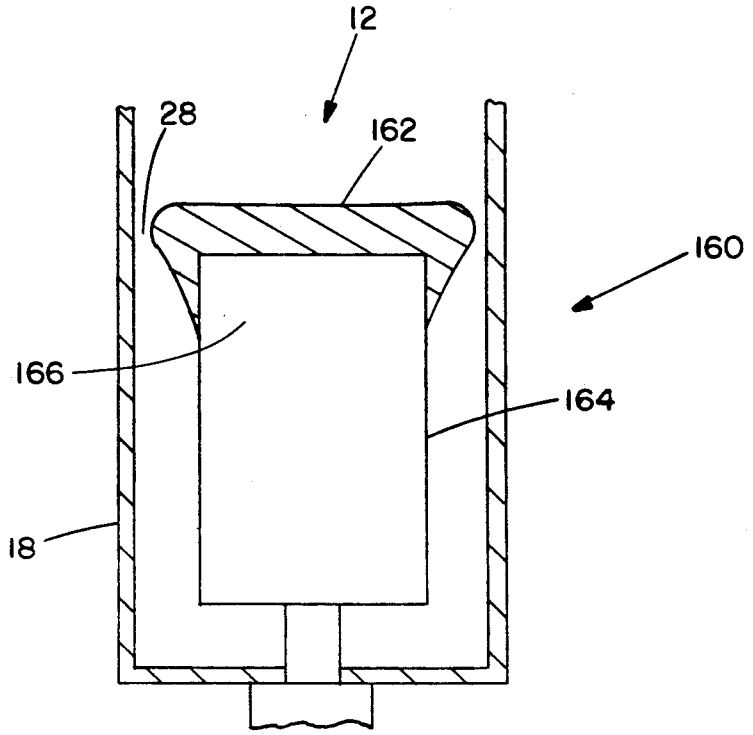
FIG. 17 is a sectional side view of a cryopump having frost buildup on the upper surfaces of the condensing cryopanel without the benefit of a frost condenser.

FIG. 17 illustrates a problem which may occur without a frost concentrator of the present invention. The gases which condense on the exterior of cylindrical cryopanel 20 such as argon which enter the interior of radiation shield 18 of cryopump 160 through opening 12 tend to condense heavily on the upper surfaces 166 of condensing cryopanel 164. Although not shown as such, the array 164 would be open with baffle to allow flow of gas to adsorbent within the array. Condensing gases form frost blanket 162 on upper surfaces 166 of condensing cryopanel 164 significantly narrowing the gap 28 between condensing cryopanel 164 and radiation shield 18. The result is that gases have limited access to the lower surfaces of condensing cryopanel 164 thereby decreasing the pumping speed and efficiency of cryopump 160. The present invention addresses the problems caused by frost buildup by employing the use of a frost concentrator to collect frost away from the gap between the array and radiation shield.

Figure 18:
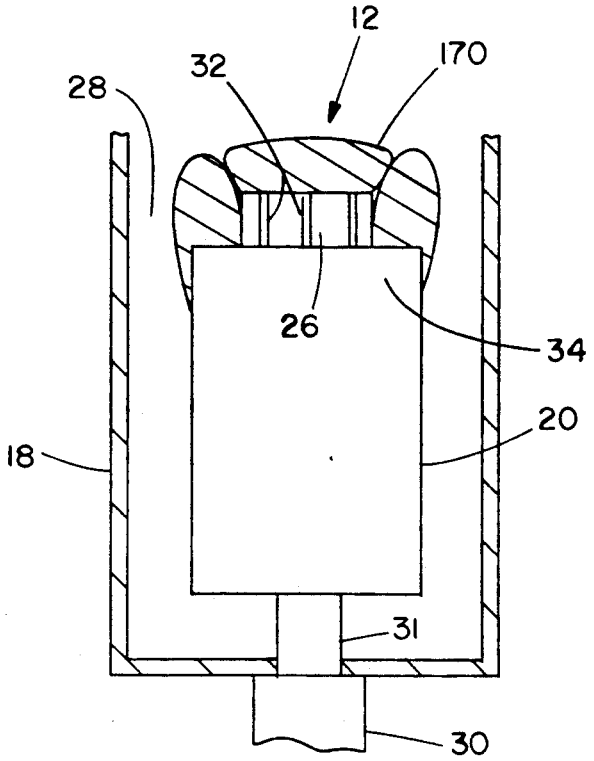
FIG. 18 is a sectional side view of the present invention showing the advantage of employing a frost concentrator regarding frost buildup.

As illustrated in FIGS. 1, 2 and 18, a portion of the lower boiling point gases which enter into the interior of radiation shield 18 condenses on frost concentrator 26. Frost concentrator 26 condenses lower boiling point gases such as argon on fins 32 before those gases can reach the upper surfaces 34 of cylindrical cryopanel 20 located in the interior of radiation shield 18. The condensing gases forms frost blanket 170 on the surfaces of frost concentrator 26. By preventing these gases from condensing on upper surfaces 34, gap 28 between cylindrical cryopanel 20 and radiation shield 18 does not become significantly narrowed by condensing gases. As a result, other gases have better access to the lower surfaces of cylindrical cryopanel 20 and charcoal box 130 (FIG. 12) housed within cylindrical cryopanel 20. By preventing gap 28 from being significantly narrowed, the pumping speed and efficiency of cryopump 10 is improved.

Figure 14:
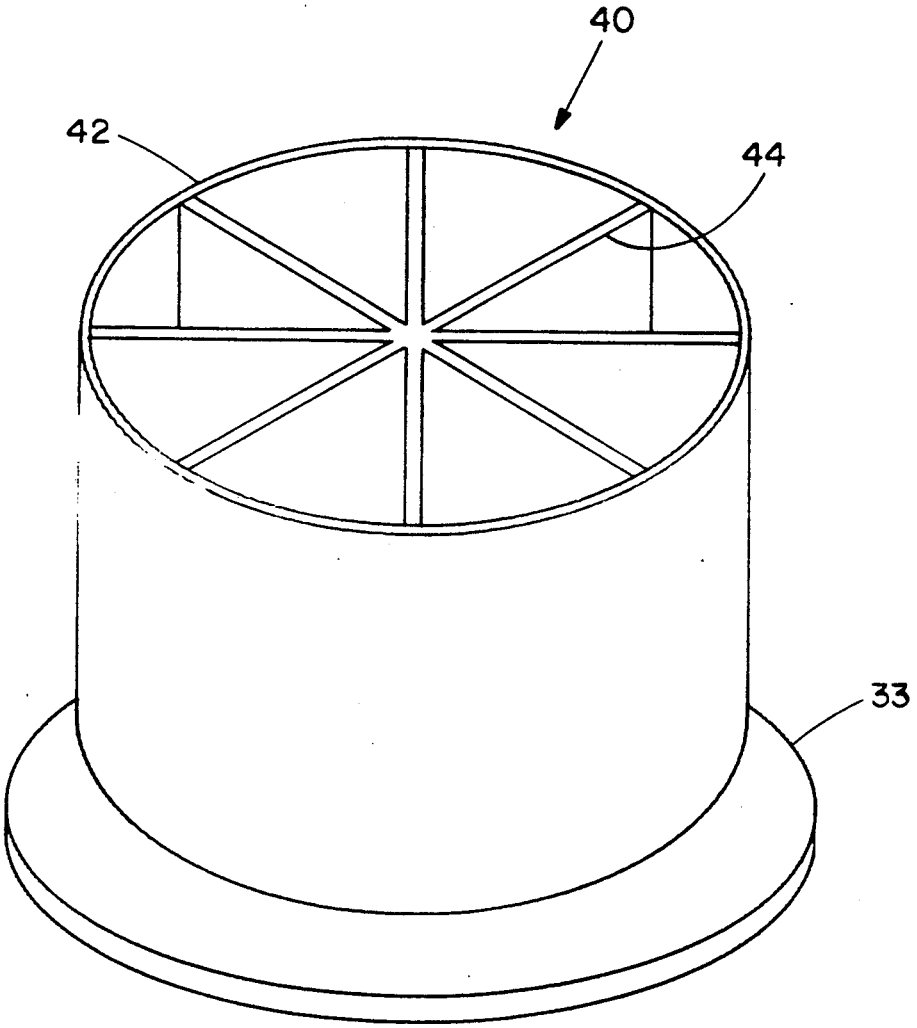
FIG. 14 is a perspective view of an alternative embodiment of the frost concentrator.
Figure 15:
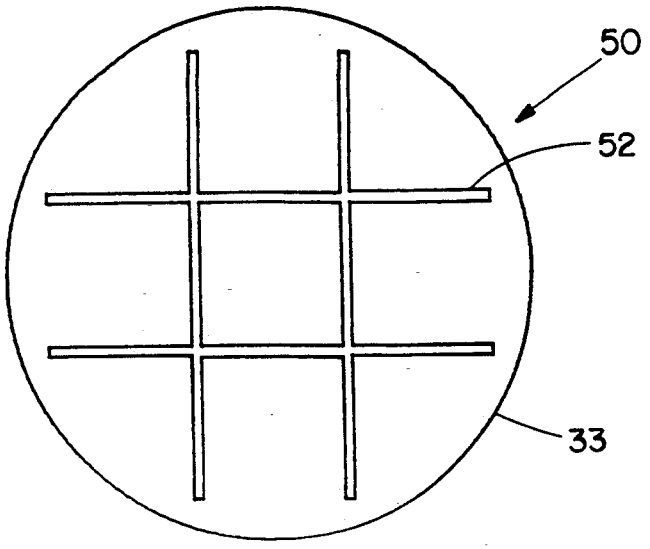
FIG. 15 is a plan view of another alternative embodiment of the frost concentrator.
Figure 16:
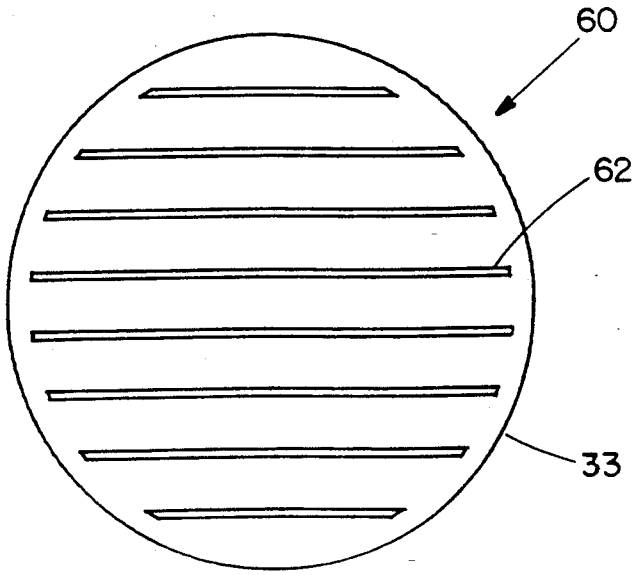
FIG. 16 is a plan view of an additional embodiment of the frost concentrator.

Frost concentrator 26 may take the form of various designs. The alternative embodiments of frost concentrator 26 shown in FIGS. 14–16 are common to each other in that each design regardless of the configuration has a plurality of surfaces which extend toward the opening of cryopump 10. FIG. 14 shows frost concentrator 40 having a plurality of radiating fins 44 crossing at the midpoints to form an asterix shaped structure and circular wall 42 surrounding and touching radiating fins 44. Fins 44 and circular wall 42 are mounted on plate 33. FIG. 15 shows a plan view of frost concentrator 50 having a plurality of fins 52 mounted to plate 33, crossing each other at right angles to form a grid shaped structure. The embodiment seen in FIG. 15 shows only four fins 52 crossing each other at right angles but any number of fins 52 or angles may be used. FIG. 16 shows a plan view of frost concentrator 60 having a plurality of fins 62 mounted to plate 33, located parallel to each other and with varying lengths so that the arrangement of fins 62 is circular. The number of fins 62 can vary and the plan view can be rectangular or any other shape.

In the preferred embodiment of FIGS. 1 and 2, frost concentrator 26 spans a substantial portion of the opening through which gases are cryopumped and is cooled to a temperature ranging from 4 to 25 K. Frost concentrator 26 is made up of a plurality of metallic radiating fins 32 crossing at the midpoints to form an asterix shaped structure. This asterix shaped structure is mounted onto plate 33. Plate 33 facilitates the mounting of frost concentrator 26 to cylindrical cryopanel 20. Alternatively, fins 32 can be made of non metallic materials which are good thermal conductors. Generally, the height of fins 32 is about one inch but the height can be varied.

Cylindrical cryopanel 20 shields charcoal box 130 (FIG. 12) from higher boiling point gases while allowing low boiling point gases access to charcoal box 130 for adsorption. Cylindrical cryopanel 20 is generally cooled to a temperature ranging from 4 to 25 K. and condenses on its surfaces lower boiling point gases such as argon. Cylindrical cryopanel 20 is fabricated from a sheet of metallic material. Radiating outward from cylindrical cryopanel 20 are a plurality of baffles 22 which have been punched from the walls of cylindrical cryopanel 20. The baffles may be cut into a flat metal sheet which is then rolled into a cylinder, or a cup may be deep drawn from a metal sheet and then cut to form the baffles.

In the preferred embodiment, baffles 22 are angled outward at a 45° angle, but a variety of angles may be used. In addition, in the preferred embodiment baffles 22 are straight, but in alternative embodiments, baffles 22 may incorporate a bend. A plurality of baffle openings 24 result from the formation of baffles 22 and the number of baffle openings 24 corresponds to the number of baffles 22. Baffles 22 are angled so that a substantial portion of baffle openings 24 are shielded from any higher boiling point gases coming from a direction perpendicular to the surfaces of radiation shield 18. This is effective in preventing higher boiling point gases from entering the interior of cylindrical cryopanel 20 because higher boiling point gases generally bounce off radiation shield 18 perpendicularly.

Additionally, baffles 22 are angled so that very low boiling point gases are allowed enter the interior of cylindrical cryopanel 20. The very low boiling point gases enter baffle openings 24 directly or by first bouncing off baffles 22. Therefore, cylindrical cryopanel 20 shields charcoal box 130 housed within from higher boiling point gases to prevent those gases from condensing on the charcoal. Baffle openings 24 allow very low boiling point gases such as hydrogen to enter the interior of cylindrical cryopanel 20 where those gases are adsorbed by charcoal box 130 (FIG. 12) housed within cylindrical cryopanel 20.

The frontal array 14 and radiation shield 18 are cooled by cold finger 30 while frost concentrator 26, cylindrical cryopanel 20 and charcoal box 130 (FIG. 12) are cooled by cold finger 31. Both cold fingers 30 and 31 are cooled by refrigeration unit 150.

Figure 3:
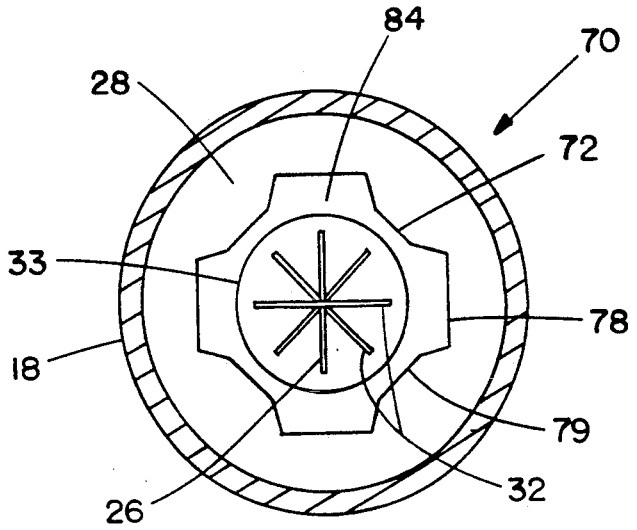
FIG. 3 is a section plan view of an alternative embodiment of the present invention for a cryopump having an opening on the top showing the frost concentrator affixed to the top of a polygonal condensing cryopanel enclosed in the radiation shield.
Figure 4:
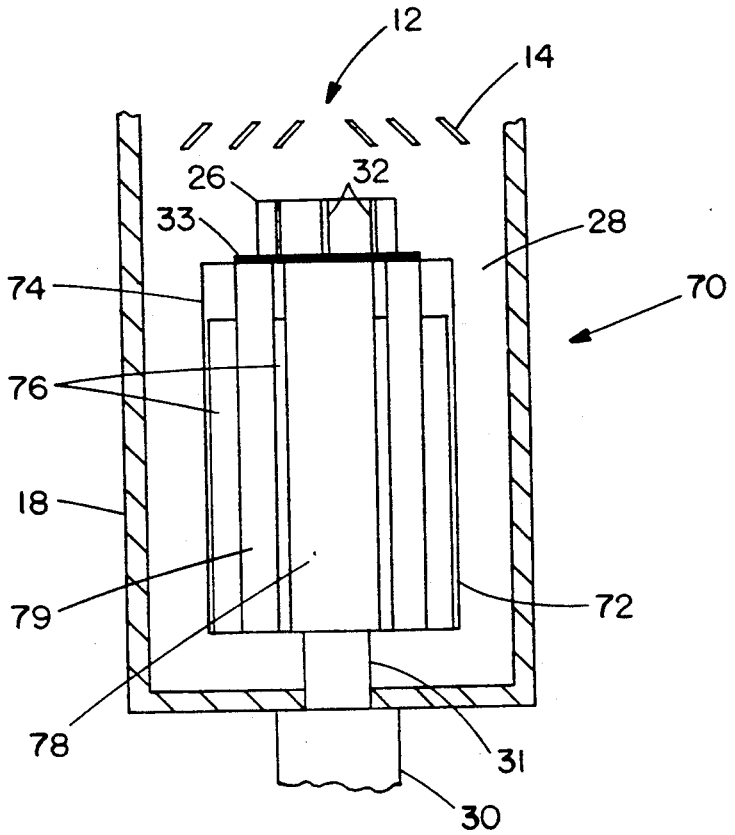
FIG. 4 is a sectional side view of the same embodiment of the present invention shown in FIG. 3.

FIGS. 3 and 4 show cryopump 70 which is an embodiment of the present invention similar to cryopump 10 shown in FIGS. 1 and 2. Cryopump 70 operates in the same manner as cryopump 10 (FIGS. 1 and 2), the only difference being that cryopump 70 has polygonal cryopanel 72 occupying the interior of radiation shield 18.

Figure 12:
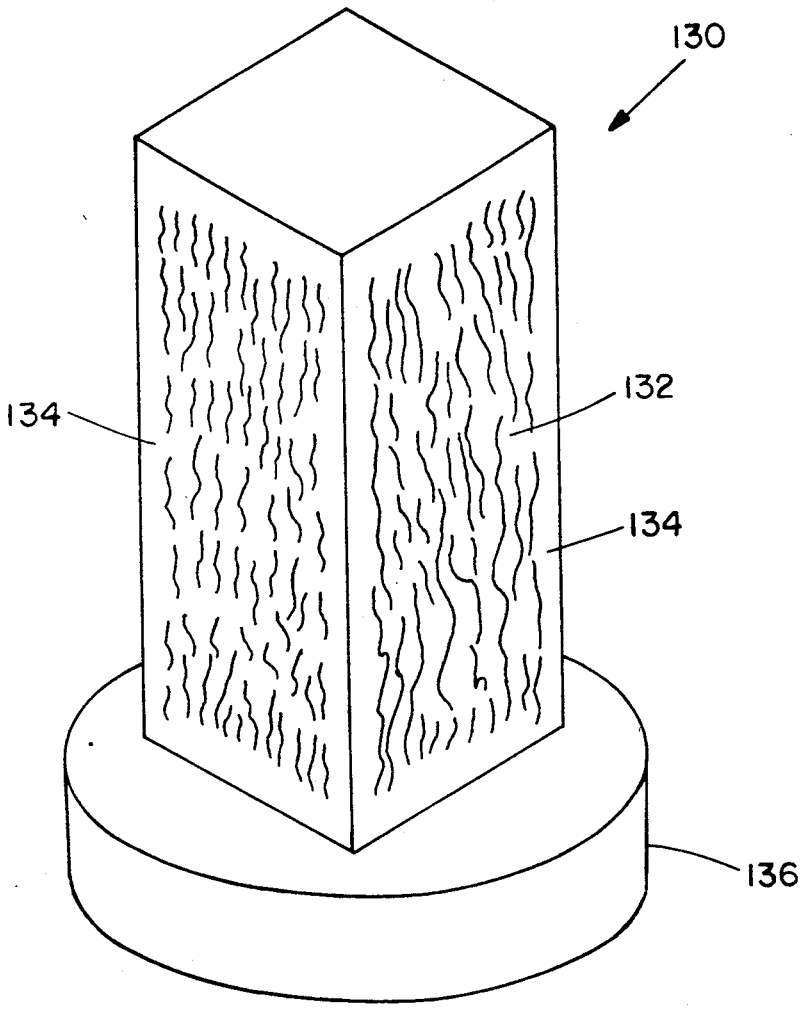
FIG. 12 is a perspective view of a cryopanel to which adsorbent material is adhered to some of the outer surfaces.

Polygonal cryopanel 72 has four faces 78 and four faces 79 which are radially staggered, faces 78 being on a larger radius than faces 79. Each face 78 is next to a face 79 with a slit 76 therebetween. Slits 76 are oriented at an angle so that slits 76 are small when looking perpendicularly from radiation shield 18 and large when looking at a nonperpendicular angle from radiation shield 18. In this manner, higher boiling point gases bouncing perpendicularly from radiation shield 18 are substantially prevented from entering polygonal cryopanel 72 while a portion of very low boiling point gases,which bounce from radiation shield 18 at nonperpendicular angles are allowed to enter the interior of polygonal cryopanel 72. In an alternative embodiment there can be any number of faces 78, faces 79 or slits 76. Charcoal box 130 (FIG. 12) is housed within polygonal cryopanel 72 and slits 76 in the walls of polygonal cryopanel 72 allow low boiling point gases such as hydrogen access to charcoal box 130 (FIG. 12). Radial staggering of faces 78 and faces 79 allows low boiling point gases through polygonal cryopanel 72 but condenses higher boiling point gases moving perpendicular to radiation shield 18 which are likely to hit either faces 78 or faces 79.

Figure 11:
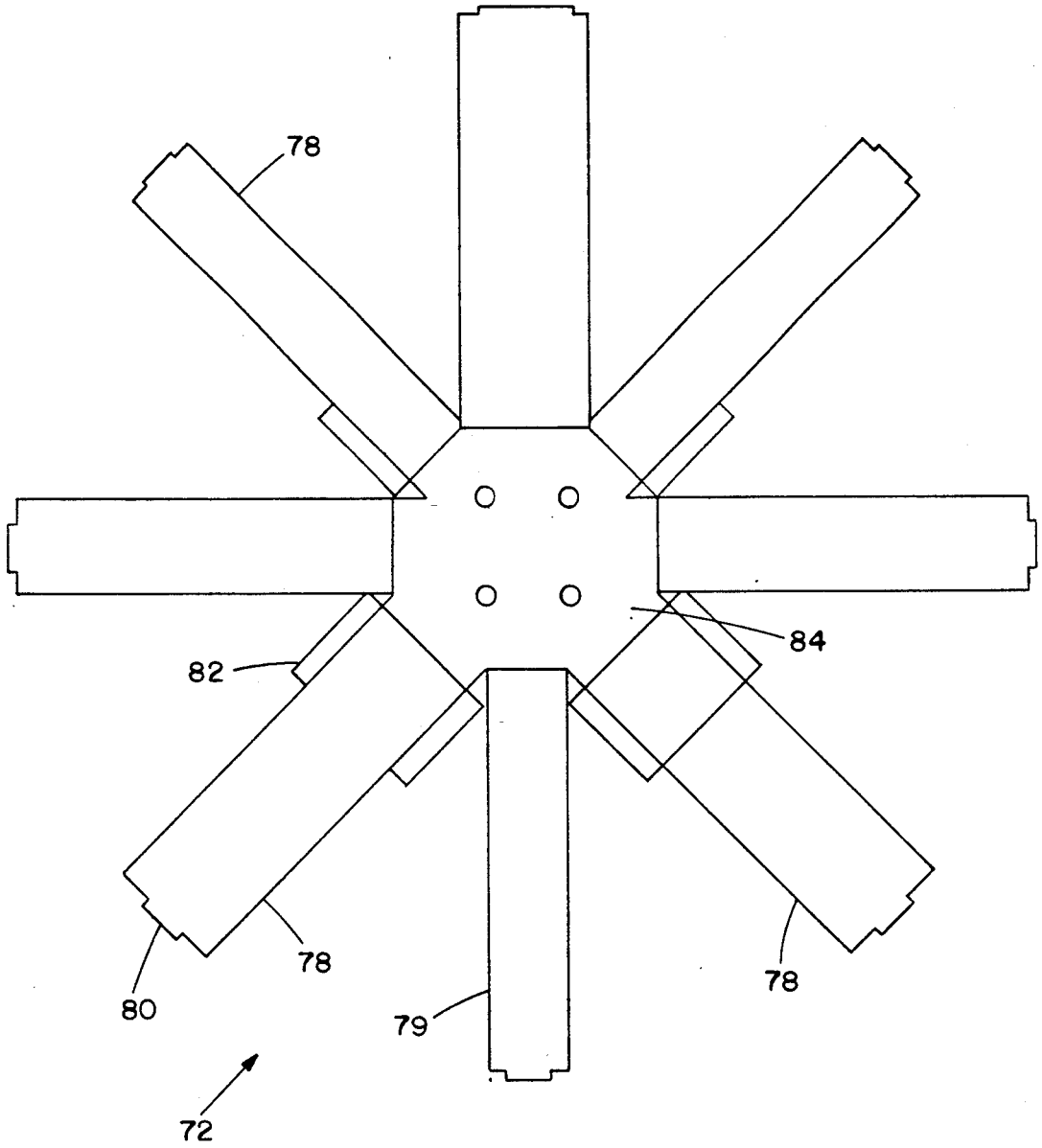
FIG. 11 is a plan view of the polygonal condensing cryopanel before being folded into a three dimensional structure.

FIG. 11 shows polygonal cryopanel 72 before being folded into a three dimensional structure. In the preferred embodiment polygonal cryopanel 72 is made from a sheet of high thermal conductive metallic material such as copper. Alternatively, polygonal cryopanel 72 can be made out of any sheet material that is a good conductor. Faces 78 and faces 79 are folded down and tabs 80 are inserted into corresponding slots within a base to stabilize polygonal cryopanel 72's structure. Wings 82 are folded inward until meeting an adjacent face 78. The purpose of wings 82 is to stop slits 76 (FIG. 4) from reaching the top of polygonal cryopanel 72. Gases not condensed on frost concentrator 26 (FIG. 4) will most likely to be condensed on upper surface 74 (FIG. 4) of polygonal cryopanel 72. Therefore, closing off slits 76 (FIG. 4) at the upper end of polygonal cryopanel 72 insures a significant added probability of condensing gases on polygonal cryopanel 72 without significantly slowing the access for noncondensables (low boiling point gases) to charcoal box 130 (FIG. 12). Additionally, by not having slits 76 reach the top of polygonal cryopanel 72, excess gases condensing on the upper surfaces 74 of polygonal cryopanel 72 are prevented from condensing on charcoal box 130 (FIG. 12) housed within polygonal cryopanel 72. Frost concentrator 26 (FIG. 4) is affixed to the top 84 (FIGS. 3 and 11) of polygonal cryopanel 72.

Figure 5:
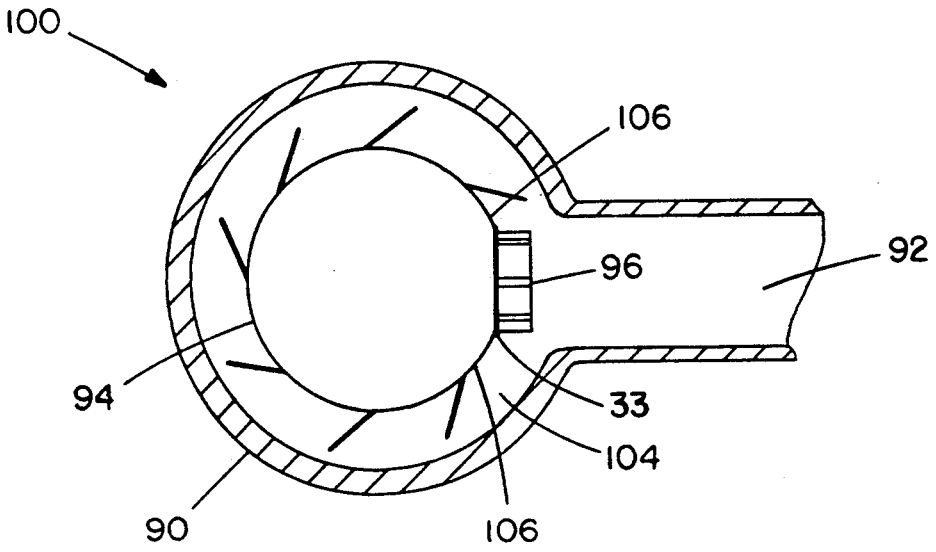
FIG. 5 is a section plan view of the preferred embodiment of the present invention when the opening for cryopumping gases is perpendicular to the axis of the condensing cryopanel. In this embodiment, the frost concentrator is affixed to the side of a cylindrical condensing cryopanel.
Figure 6:
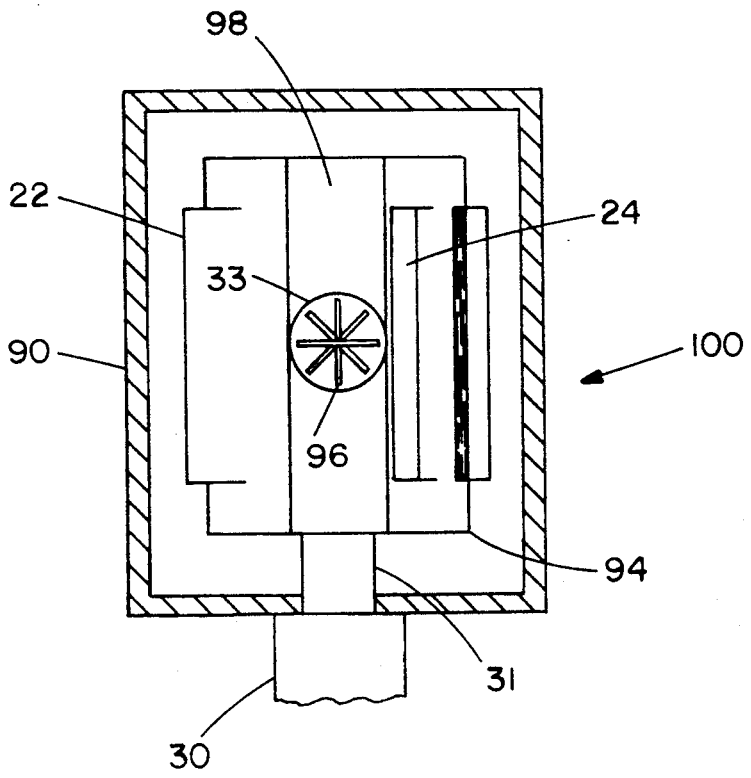
FIG. 6 shows a sectional side view of the embodiment of the present invention shown in FIG. 5 seen from the direction looking at the frost concentrator.

FIGS. 5 and 6 show cryopump 100, for situations where opening 92 for gases to be cryopumped is located perpendicular to the axis of cylindrical cryopanel 94. Cylindrical cryopanel 94 is similar to cylindrical cryopanel 20 (FIGS. 1 and 2) except that flat 98 has been put on the side of cylindrical cryopanel 94 for affixing frost concentrator 96 to the side of cylindrical cryopanel 94. Frost concentrator 96 is positioned to face opening 92. This allows gases cryopumped through opening 92 to condense on frost concentrator 96, preventing an excess of gases from condensing on surfaces 106 of cylindrical cryopanel 94 which are closest to opening 92. By preventing an excess of gases from condensing on surfaces 106, gap 104 between radiation shield 90 and cylindrical cryopanel 94 does not significantly narrow. This allows gases easier access to surfaces of cylindrical cryopanel 94 on the opposite side of opening 92 or to enter baffle openings 24 for condensing onto charcoal box 130 (FIG. 12).

Figure 7:
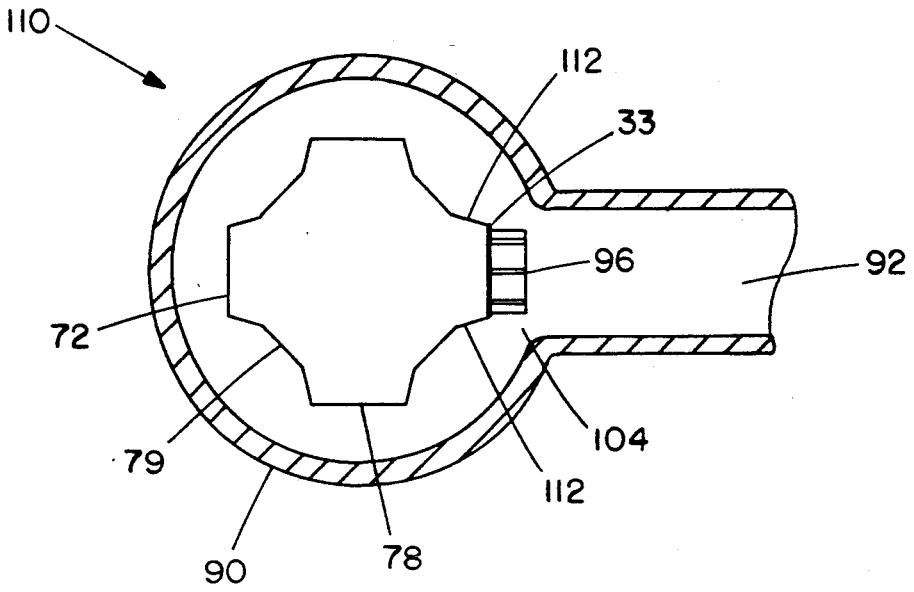
FIG. 7 is a section plan view of an alternative embodiment of the present invention when the opening for cryopumping gases is perpendicular to the axis of the condensing cryopanel. In this embodiment, the frost concentrator is affixed to the side of a polygonal condensing cryopanel.
Figure 8:
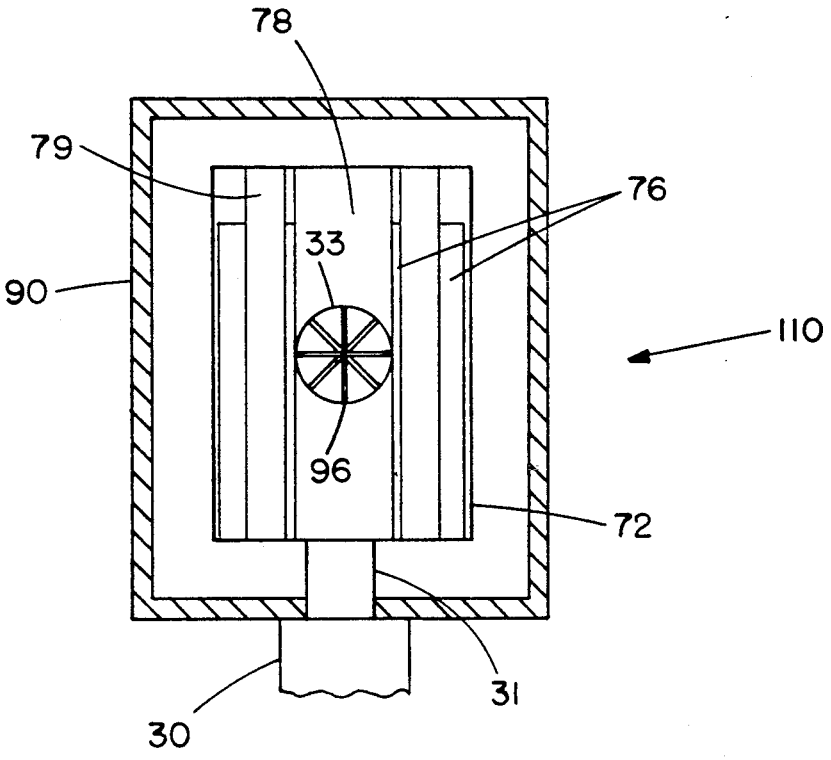
FIG. 8 is a sectional side view of the embodiment of the present invention shown in FIG. 7 seen from the direction looking at the frost concentrator.

FIGS. 7 and 8 show cryopump 110, for situations where the opening 92 for gases to be cryopumped is located perpendicular to the axis of polygonal cryopanel 72. Polygonal cryopanel 72 is the same as polygonal cryopanel 72 (FIGS. 3 and 4) except that frost concentrator 96 is affixed to the side of polygonal cryopanel 72 on face 78.

Cryopump 110 operates in similar fashion to that of cryopump 100 depicted in FIGS. 5 and 6. Frost concentrator 96 is positioned to face opening 92. This allows gases cryopumped through opening 92 to condense on frost concentrator 96, preventing an excess of gases from condensing on surfaces 112 of polygonal cryopanel 72 which are closest to opening 92. By preventing an excess of gases from condensing on surfaces 112, gap 104 between radiation shield 90 and polygonal cryopanel 72 does not significantly narrow. This allows gases easier access to surfaces of polygonal cryopanel 72 which are on the opposite side of opening 92 or to enter slits 76 for condensing onto charcoal box 130 (FIG. 12).

Figure 9:
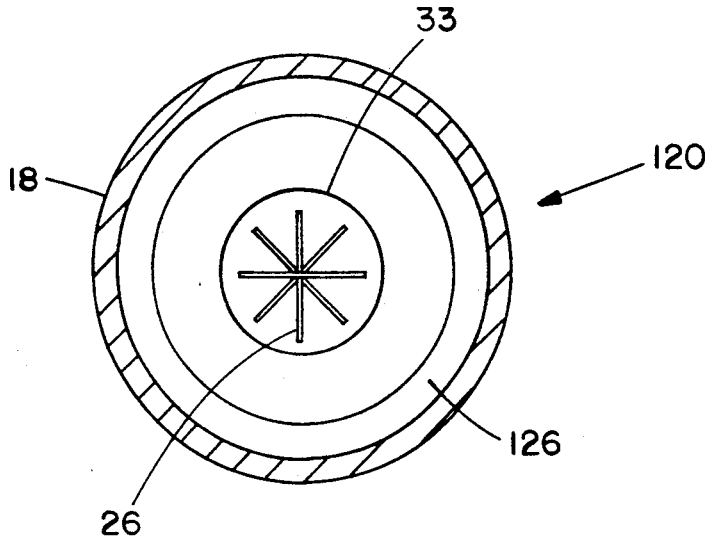
FIG. 9 is a sectional plan view of an alternative embodiment of the present invention showing the frost concentrator affixed to the top of a conventional condensing cryopanel baffling device enclosed in a radiation shield.
Figure 10:
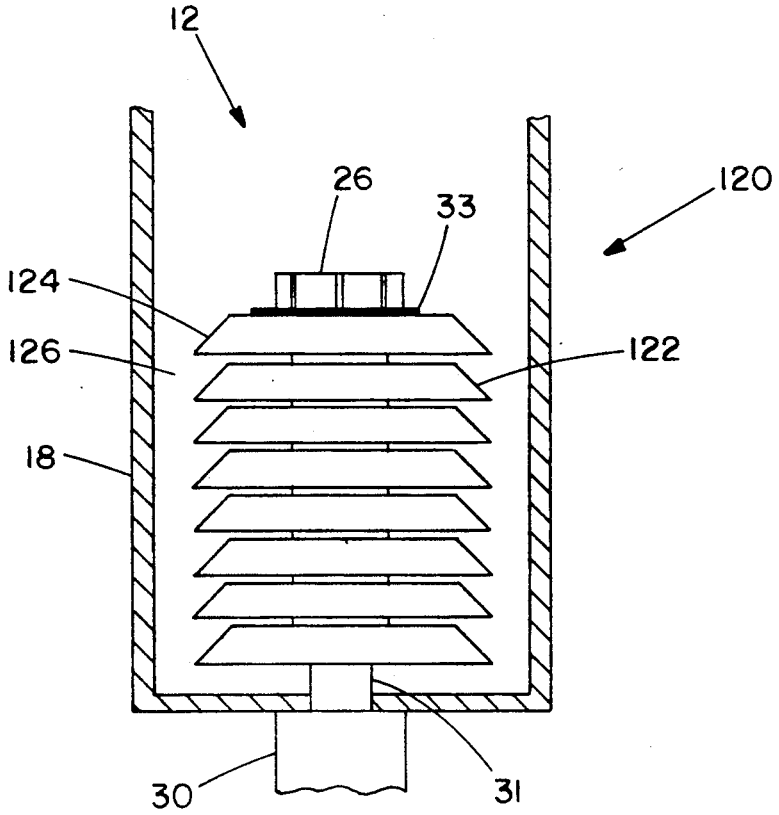
FIG. 10 is a sectional side view of the present invention shown in FIG. 9 which additionally shows the cold fingers.

FIGS. 9 and 10 shows cryopump 120 which has a conventional cryopanel 122 occupying the interior of radiation shield 18. Frost concentrator 26 is affixed to the top of conventional cryopanel 122. A portion of gases cryopumped through opening 12 and entering the interior of radiation shield 18 condenses on frost concentrator 26. This prevents an excess of gases from condensing on upper surfaces 124 of conventional cryopanel 122 thereby preventing condensing gases from significantly narrowing gap 126 between radiation shield 18 and conventional cryopanel 122.

FIG. 12 shows charcoal box 130 which is housed within cryopanels 20, 72 and 94 (shown in FIGS. 1–7). The main body of charcoal box 130 is a hollow box having a rectangular cross section but may be a cylinder or of any other form. Base 136 of charcoal box 130 has the structure of a hollow disc with an open bottom. Charcoal granules 132 are adhered to the four faces 134 by an adhesive. The charcoal granules 132 adsorb low boiling point gases such as hydrogen when charcoal box 130 is cooled to temperatures ranging from 4 to 25 K. Other adsorbent materials may be used instead of charcoal.

Figure 13:
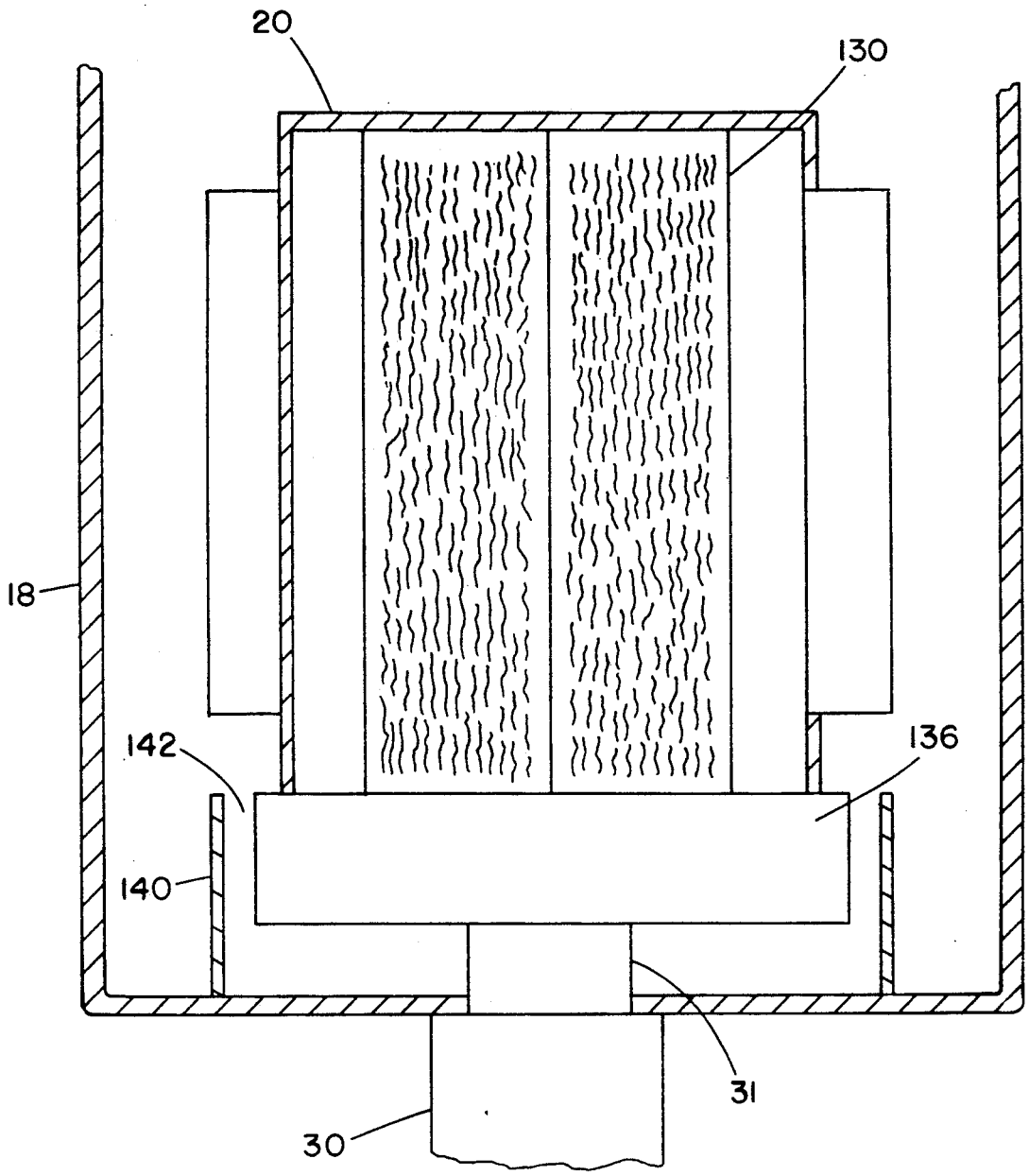
FIG. 13 is a sectional side view of the present invention showing a cryopanel having adsorbent material adhered to outer surfaces, a cylindrical condensing cryopanel substantially enclosing the adsorbent material cryopanel, and a radiation shield having a flange creating a passageway between the flange and the cryopanel.

FIG. 13 shows charcoal box 130 enclosed within cylindrical cryopanel 20. In the embodiment depicted in FIG. 13 cylindrical cryopanel 20 rests on base 136 of charcoal box 130. In an alternative embodiment cylindrical cryopanel 20 can fit over base 136 of charcoal box 130. Flange 140 protrudes from the bottom of radiation shield 18 and surrounds base 136 with a gap 142 between flange 140 and base 136. The purpose of flange 140 is to provide a narrow passage way which limits the amount of gases condensing on the refrigerated cold finger as disclosed in U.S Pat. application, Ser. No. 07/647,848 filed Jan. 30, 1991.

While this invention has been particularly shown and described with references to preferred embodiments thereof, it will be understood by those skilled in the art that various changes in form and details may be made therein without departing form the spirit and scope of the invention as defined by the appended claims.

We claim:

1. A cryopump comprising:

a vacuum vessel having an opening through which gases are cryopumped;

a cryogenic refrigerator;

a cryopanel in the vacuum vessel cooled to cryogenic temperatures by the cryogenic refrigerator and supporting adsorbent for adsorbing gases therein; and a condensing cryopanel cooled to cryogenic temperatures by the cryogenic refrigerator facing the opening in the vacuum vessel and shielding the adsorbent from gases passing through the opening, the condensing cryopanel having surfaces extending therefrom toward the opening to condense gases.

2. The cryopump of claim 1 where the cryopanel supporting absorbent comprises a hollow structure having a rectangular cross section.

3. The cryopump of claim 1 where the condensing cryopanel comprises a hollow cylinder having a cavity therein and an outer wall, said outer wall having a plurality of openings therein, with a corresponding plurality of louvres protruding from said outer wall.

4. The cryopump of claim 1 where the condensing cryopanel comprises a hollow structure having a polygonal cross section, said hollow structure having a cavity therein and outer walls, said outer walls being staggered to provide a plurality of openings therebetween.

5. The cryopanel array of claim 1 where the condensing cryopanel is folded from a sheet to form a hollow structure having a polygonal cross section, said hollow structure having a cavity therein and outer walls, said outer walls being staggered to provide a plurality of openings therebetween.

6. The cryopanel array of claim 1 where the condensing cryopanel is rolled from a sheet to form a tube having a cavity within outer walls, said outer walls having a plurality of louvres and openings formed therein.

7. The cryopanel array of claim 1 where the baffle device is made from a sheet of metallic material.

8. The cryopump of claim 1 where the condensing cryopanel substantially encloses the supporting adsorbent cryopanel.

9. The cryopump of claim 1 where the surfaces extending away from the condensing cryopanel comprise a plurality of fins arranged so that the fins cross one another at the midpoints.

10. The cryopump of claim 9 wherein the plurality of fins extend towards the opening from a plate which spans a substantial portion of the opening.

11. The cryopump of claim 1 further comprising of a radiation shield substantially surrounding the condensing cryopanel, there being a space between said radiation shield and said condensing cryopanel, the surfaces extending from said condensing cryopanel preventing an excess of gases from condensing within said space.

12. A cryopanel array for use in a cryopump having an opening through which gases are cryopumped, the array comprising:

a baffle device to be cooled to cryogenic temperatures and for facing the opening through which gases are cryopumped; and a frost concentrator to be cooled to cryogenic temperatures having a plurality of surfaces for extending towards the opening, said frost concentrator being affixed to an outer surface of said baffle device which is in the closest proximity to the opening.

13. The cryopanel array of claim 12 further comprising an adsorbent material cooled to cryogenic temperatures, said adsorbent material capable of adsorbing lower boiling point gases.

14. The cryopanel array of claim 13 where the adsorbent material comprises charcoal.

15. The cryopanel array of claim 12 where the frost concentrator comprises a plurality of fins arranged so that the fins cross one another at the midpoints.

16. The cryopanel array of claim 12 wherein the plurality of surfaces of the frost concentrator extend towards the opening from a plate which spans a substantial portion of the opening.

17. The cryopanel array of claim 12 where the frost concentrator is affixed to the top of the baffle device.

18. The cryopanel array of claim 12 where the frost concentrator is affixed to the side of the baffle device.

19. The cryopanel array of claim 12, where said cryopanel array is substantially surrounded by a radiation shield, there being a space between said radiation shield and said cryopanel array, the frost concentrator preventing an excess of gases from condensing within said space.

20. The cryopanel array of claim 12 where the baffle device comprises a hollow cylinder having a cavity therein and an outer wall, said outer wall having a plurality of openings therein, with a corresponding plurality of louvres protruding from said outer wall.

21. The cryopanel array of claim 20 where the baffle device substantially encloses an adsorbent material adhered to a supporting structure.

22. The cryopanel array of claim 21 where the adsorbent material comprises charcoal.

23. The cryopanel array of claim 21 where the supporting structure comprises a hollow structure having a rectangular cross section.

24. The cryopanel array of claim 12 where the baffle device comprises a hollow structure having a polygonal cross section, said hollow structure having a cavity therein and outer walls, said outer walls being staggered to provide a plurality of openings therebetween.

25. The cryopanel array of claim 24 where the baffle device substantially encloses an adsorbent material adhered to a supporting structure.

26. The cryopanel array of claim 25 where the adsorbent material comprises charcoal.

27. The cryopanel array of claim 25 where the supporting structure comprises a hollow structure having a rectangular cross section.

28. The cryopanel array of claim 12 where the baffle device is folded from a sheet to form a hollow structure having a polygonal cross section, said hollow structure having a cavity therein and outer walls, said outer walls being staggered to provide a plurality of openings therebetween.

29. The cryopanel array of claim 12 where the baffle device is rolled from a sheet to form a tube having a cavity within and outer walls, said outer walls having a plurality of louvres and openings formed therein.

30. The cryopanel array of claim 12 where the baffle device is made from a sheet of metallic material.

31. A method of cryopumping gases comprising the steps of:

removing gases with a first stage cryopanel cooled to cryogenic temperatures, said first stage cryopanel having a plurality of baffled surfaces;

removing further gases with a frost concentrator cooled to cryogenic temperatures, said frost concentrator having surfaces extending towards an opening to a work chamber;

removing still further gases with a second stage cryopanel cooled to cryogenic temperatures, said frost concentrator being affixed to said second stage cryopanel;

removing additional gases with an adsorbent cooled to cryogenic temperatures.

32. The method of cryopumping gases of claim 31 where the frost concentrator condenses gases on the surfaces of said frost concentrator, maintaining access for other gases to condense on the second stage cryopanel and on the absorbent.

33. The method of cryopumping gases of claim 31 where a radiation shield substantially surrounds the second stage cryopanel, there being a space between said radiation shield and said second stage cryopanel, the surfaces extending from said condensing cryopanel preventing an excess of gases from condensing within said space.

34. A cryopanel array comprising a folded sheet baffle device forming a hollow structure having a polygonal cross section, said hollow structure having a cavity therein and outer walls, said outer walls being bent from an end member and being staggered to provide a plurality of openings therebetween.

35. A cryopanel array comprising a baffle device of sheet material for enclosing an adsorbent material, the improvement wherein:

the bafffle device is configured such that portions bent out from the sheet material form louvres adjacent to openings left by the louvre material.

36. The cryopanel of claim 35 where the baffle device is a rolled sheet tube having a cavity within an outer wall, said outer wall having a plurality of louvres bent from the tube to leave openings formed therein.

37. The cryopanel array of claim 36 where the baffle device is made from a sheet of metallic material.

38. A cryopump comprising:

a cryogenic refrigerator; and a cryopanel array cooled by the refrigerator and surrounding adsorbent material, the array comprising sheet material formed such that portions bent out from the sheet material form louvres adjacent to openings left by the louvre material.

39. A cryopump of claim 38 where the baffle device is a rolled sheet tube having a cavity within an outer wall, said outer wall having a plurality of louvres bent from the tube to leave openings formed therein.

40. The cryopump of claim 39 where the baffle device is made from a sheet of metallic material.

* * * * *